US005445286A

United States Patent [19]

Guimarin

[11] Patent Number: 5,445,286

[45] Date of Patent: Aug. 29, 1995

[54] BOX HAVING HEAT-RETAINING CAPABILITY

[75] Inventor: Henry L. Guimarin, Longwood, Fla.

[73] Assignee: Carol Stemper Wingo, Longwood, Fla.

[21] Appl. No.: 261,105

[22] Filed: Jun. 16, 1994

[51] Int. Cl.[6] ..... B65D 90/04

[52] U.S. Cl. ..... 220/427; 219/730; 220/428; 229/122; 229/130; 229/902; 426/109; 426/112

[58] Field of Search ..... 229/122, 130, 902, 903, 229/906; 426/109, 113, 114, 115; 219/730, 731, 759; 220/427, 428, 416, 418

[56] References Cited

U.S. PATENT DOCUMENTS

| | | | |
|---|---|---|---|
| 1,291,540 | 1/1919 | Joslin | 229/130 |
| 1,881,873 | 10/1932 | Newcomb | 220/427 |
| 2,385,866 | 10/1945 | Kuehner | 220/428 |
| 2,496,731 | 2/1950 | Longo | 426/109 |
| 2,679,244 | 5/1954 | Fucci | 220/428 |
| 3,309,206 | 3/1967 | Daniels | 426/109 |
| 3,717,478 | 2/1973 | Lipfert | 426/109 |
| 3,741,427 | 6/1973 | Doyle | 220/428 |
| 3,974,358 | 8/1976 | Goltsos . | |
| 4,190,757 | 2/1980 | Turpin et al. . | |
| 4,283,427 | 8/1981 | Winters et al. . | |
| 4,735,513 | 4/1988 | Watkins et al. . | |
| 4,848,543 | 7/1989 | Doboze . | |
| 4,931,333 | 6/1990 | Henry | 220/428 |
| 4,982,722 | 1/1991 | Wyatt | 220/427 |
| 5,052,369 | 10/1991 | Johnson . | |
| 5,338,921 | 8/1994 | Maheux et al. | 219/730 |

*Primary Examiner*—Gary E. Elkins
*Attorney, Agent, or Firm*—Julian C. Renfro

[57] ABSTRACT

A flat, comparatively shallow box containing an arrangement for keeping a comparatively flat food item warm for a protracted length of time, with this box having rectangularly-shaped top and bottom members of approximately equal size. The top and bottom members are hingedly secured together by a hinge disposed along an edge common to both members, with the top member having side members disposed along each of its remaining side edges. The bottom member has a flap disposed on the edge opposite the hinge, such that closure of the box can be effected after a comparatively flat food item has been inserted into the box. The arrangement for keeping a food item warm is a sealed container for a heat-retaining substance, the container being disposed in the interior of the box, affixed to the underside of the top member. The container is thus disposed close to, or in direct contact with, the food item when the box has been closed, with the heat-retaining substance, having earlier been brought up to a selected raised temperature, serving by its proximity to keep the food item warm.

18 Claims, 2 Drawing Sheets

BOX HAVING HEAT-RETAINING CAPABILITY

BACKGROUND OF THE INVENTION

A number of patents have been granted to date upon boxes designed for providing hot food to a consumer. For example, the Turpin U.S. Pat. No. 4,190,757 entitled "Microwave Heating Package and Method" pertains to a paperboard carton designed to receive food to be cooked, under controlled circumstances, in a microwave oven. Although this patent relates to a generally satisfactory device, it is much more complicated and much more expensive than can be justified for providing hot food to a consumer in many circumstances.

The Doboze U.S. Pat. No. 4,848,543 entitled "Disposable Foam Plastic Pizza Container" pertains to a thermally insulated disposable container for pizzas, pies and other round, flat food items. This patentee deliberately moves away from the use of the commonly used, square pizza boxes, and proposes the use of a pair of round, joined together sections made of polystyrene foam, or other food-compatible plastic food material. However, this also is a very expensive approach, necessitating the creation of elaborately configured molds for creating containers of this type. The efficacy of the Doboze approach is sufficiently marginal as not to justify this expense.

The Johnson U.S. Pat. No. 5,052,369 entitled "Heat Retaining Food Container" is an even more expensive and more elaborate device for receiving food items that are to be heated in a microwave oven and then served hot some considerable period of time later. Such elaborate and expensive approaches as this, despite their commendable features, simply cannot be justified in most circumstances, such as in connection with the local delivery of fast foods.

It was to overcome the disadvantages of these approaches, and to make possible the economical delivery of fast food in a satisfactorily hot condition in boxes generally along the lines of conventional configuration that the instant invention was created.

SUMMARY OF THE INVENTION

In accordance with this invention a flat, comparatively shallow box is provided for keeping a comparatively flat food item warm for a protracted length of time. This novel box has rectangularly-shaped top and bottom members of approximately equal size, which top and bottom members have four edges, with these members being hingedly secured together by the use of hinge means disposed along an edge common to both members. The top member has sides disposed along each of the other three edges, with these sides being of firm construction. The bottom member has at least one flap, which is disposed on the edge opposite the hinge means, such that closure of the box can be effected after a comparatively flat food item has been inserted into the box.

Significantly, a flat container for a heat-retaining substance is secured in the interior of the box, on the underside of the top member or lid, such container thus being disposed close to a freshly baked food item placed in the box just before the box is closed. The heat retaining substance, having earlier been raised to a selected elevated temperature, serves by its proximity to keep the food item warm for a protracted length of time. The flap or flaps utilized on the bottom member are of a selected height so as to cause, when the flaps have been placed inside the side members of the top member and the box closed, the container for the heat-retaining substance to be disposed a consistent and appropriately close distance with respect to the food item to be kept warm.

It is a primary object of my invention to provide a flat, comparative shallow box of non-expensive construction, to be utilized in a non-obvious and highly advantageous manner for keeping a food item warm for a protracted length of time.

It is another object of this invention to provide a procedure for making it possible to utilize a substantially flat box of essentially standard and inexpensive construction, to the interior of which a container for a heat retaining material is advantageously added, with this container being disposed close to a flat food item, such as a pizza, that is placed in the box, so as to keep the food item warm for a protracted length of time.

It is yet another object of this invention to provide a substantially flat, easily manufactured and disposable warm food box having top and bottom members of substantially equal size, but with the top member of the box having sufficient thickness dimension as to enable a relatively inexpensive heat-retaining member to be affixed on the underside of the top member, so as to reside close to a food item carried in the box, to keep the food item warm for a substantial length of time.

It is yet still another object of my invention to provide a warm food box having top and bottom members of rectangular configuration, with one edge of the top member hingedly connected to the bottom member, but with the other edges supporting sides of substantially equal height, thus to define a location in an upper interior portion of the box for a heat-retaining member to be disposed on the underside of the top member, such heat-retaining member being able, when brought up to a desired temperature, to reside close to a food item resting on the bottom of the box, to keep the food item quite warm after the box has been closed.

It is yet still another object of this invention to provide a substantially flat, easily manufactured and disposable warm food box having top and bottom members of substantially equal size, with means utilized adjacent the hinge portion of the box for limiting the degree to which the box can be opened, thus to prevent a user being injured by coming into contact with a heat-retaining means that has been brought up to temperature, that is utilized on the underside of the lid of the box for keeping the food warm.

It is yet still another object of this invention to provide a substantially flat box containing means for keeping a comparatively flat food item warm for a protracted length of time, in which an insert member is utilized for directly supporting the food item, thus expediting the insertion of the food item into the box as well as the removal of the food item from the box when restraint means utilized adjacent the hinge of the box inhibit the opening of the box to a wide extent.

These and other objects, features and advantages of this invention will be more apparent as the description proceeds.

DETAILED DESCRIPTION

Figure 1:
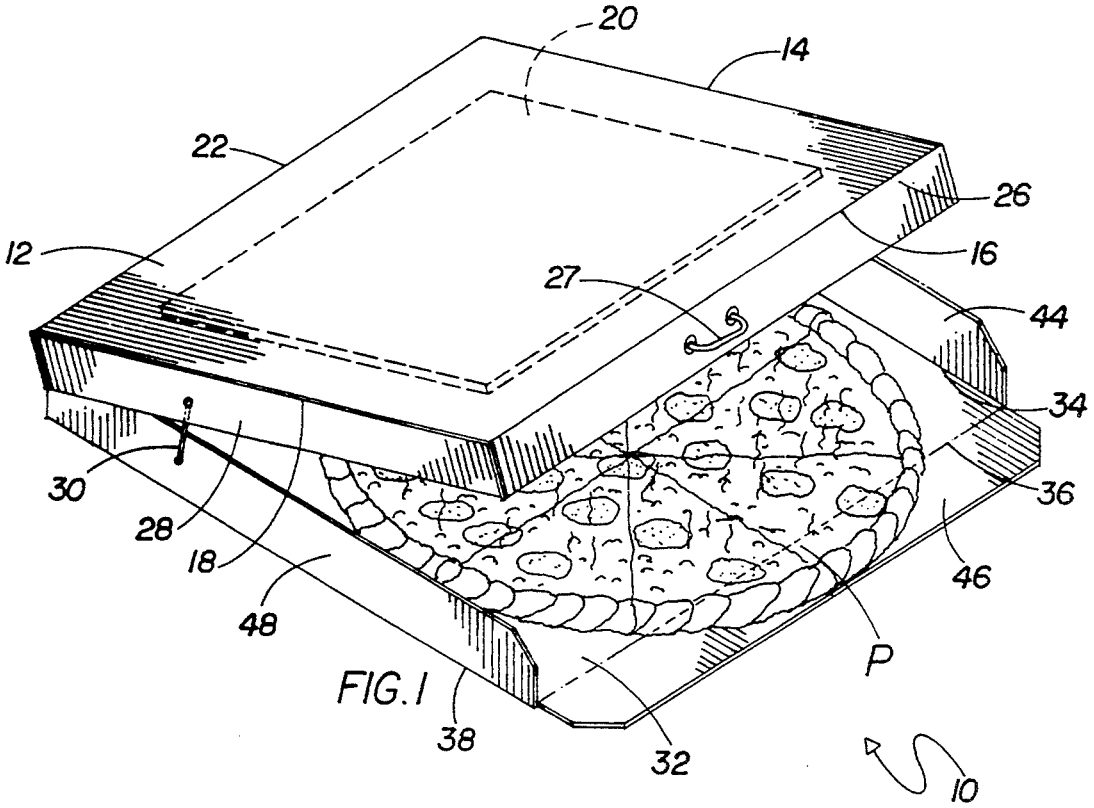
FIG. 1 is a perspective view of a primary embodiment of my novel box, with the top partially open in order to reveal the manner in which the box may be opened to permit the insertion of a flat food item to be kept warm into the box, or the removal of the food item from the box.

A primary embodiment of my flat, comparatively shallow box 10 containing means for keeping a comparatively flat food item warm for a protracted length of time is revealed in FIG. 1. The box 10 has rectangularly shaped top and bottom members 12 and 32 of substantially equal size, with the top member 12 having edges 14, 16 and 18. The bottom member 32 has corresponding edges 34, 36 and 38. Both the top member and the bottom member may be made of the same low cost material, such as corrugated paper, cardboard, paperboard, plastic or the like.

Figure 3:
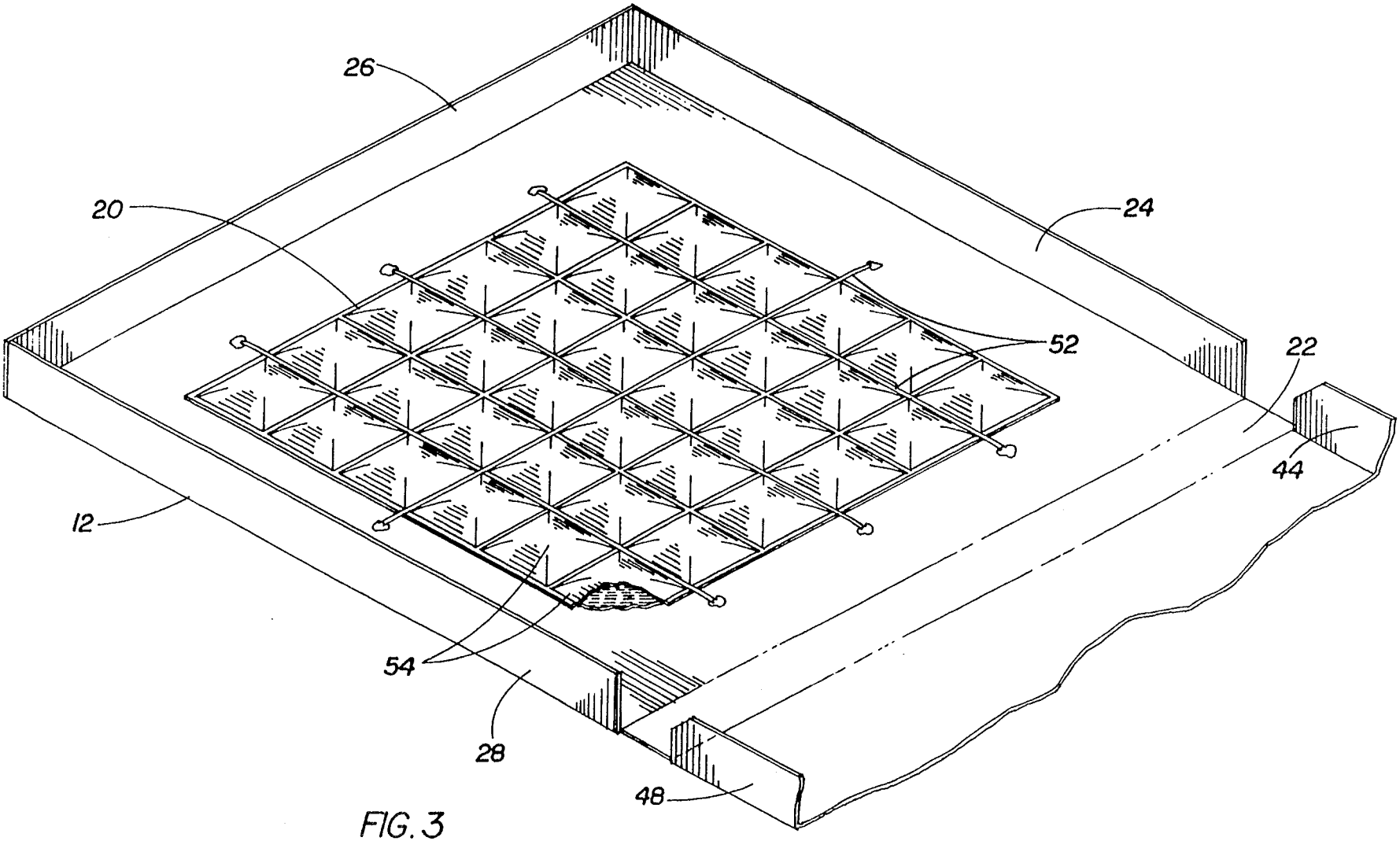
FIG. 3 is a view of the interior of the top portion of my novel box, revealing one means that may be used for securing my novel, substantially flat heat-retaining means on inner side of the top member of the box.

The top and bottom members 12 and 32 are hingedly interconnected by the use of hinge means 22 disposed along a common edge, which may be regarded as the rear edge of the box 10. The hinge means is best seen in FIG. 3. The top member 12 has side members 24, 26 and 28 generally perpendicular to the principal surface of the top member 12, with these sides or side members being attached along the edges 14, 16 and 18, respectively. However, side 24 is not visible in FIG. 1.

Revealed in FIG. 1 are the flaps or flap members 44, 46 and 48 of the bottom member 32, which may be regarded as affixed in a hinged manner to the edges 34, 36 and 38 of the bottom member, respectively.

Figure 1A:
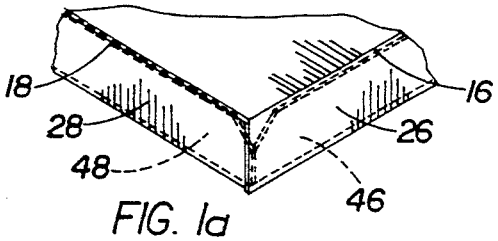
FIG. 1*a* is a fragmentary view of a front corner of my novel box, showing how the flaps of the bottom member are to be inserted inside the side members of the top member of the box when the box is closed.

The sides or side members 24, 26 and 28 are comparatively rigid, with front side 26 forming a relatively strong interconnection with sides 24 and 28. Because the comparatively rigid side members 24, 26 and 28 as well as the flap members 44, 46 and 48 associated with the bottom member 32 are of an essentially consistent height dimension, substantially all portions of the top and bottom members will be disposed an essentially equal distance apart when the box has been closed. It is to be noted that the flaps 44, 46 and 48 are to be inserted inside the side members 24, 26 and 28 when the box is closed, such that the tops of the flap members 44, 46 and 48 will be brought into contact with the upper interior portion of the top member 12. Note in FIG. 1*a* that the flap members 46 and 48 are revealed as residing inside the side members 26 and 28 of the top member 12 when the box 10 has been closed. A tab 27 may be provided in a center location on the outside of the front side member 26, for the convenience of the user when opening the box.

Significant to this invention is a heat-retaining member 20, which is held by a suitable securing means located on the interior of the box 10, on the underside of the top or lid 12. The member 20 is indicated by dashed lines in FIG. 1, and it will be described at greater length hereinafter.

It has previously been made clear that flaps or sides 44, 46 and 48 may be hingedly attached to the edges 34, 36 and 38 of the bottom member 32. As seen in FIG. 1, I prefer to remove the left and right corners from the front flap 46, and the forwardmost corners from the side flaps 44 and 48, to permit the user to readily insert these flaps inside the sides 24, 26 and 28 of the top member 12 when closure of the box is being effected. The flaps 44, 46 and 48 are not interconnected, and obviously do not have the relative rigidity of the side members 24, 26 and 28 that are firmly attached to the top member 10.

In FIG. 1 I reveal a relatively flat food item having been inserted into the front of the box, in this instance the food item being a pizza P. In accordance with this embodiment, the pizza is shown resting principally on the interior portion of the bottom member 32, although partially contacting the interior side of the front flap 46 in this instance. When the box is to be closed with the food item entirely inside, the front flap 46, in particular, is to be inserted inside the corresponding side member of the box lid, which in this instance is the forwardmost side member 26. This arrangement is desirable because it would be quite inappropriate for the food item, here the pizza P, to unexpectedly slide outwardly should the box 10 open to some degree while carrying the food item inside.

In many instances I prefer to utilize a restraint means 30 for preventing the box from being opened too widely; note FIG. 1. The restraint means may take the form of a cord or strap, located comparatively near to the hinge means 22, and anchored to both the top member 12 and the bottom member 32. The restraint means may be made of nylon, for example, but obviously I am not to be limited to this.

Figure 2:
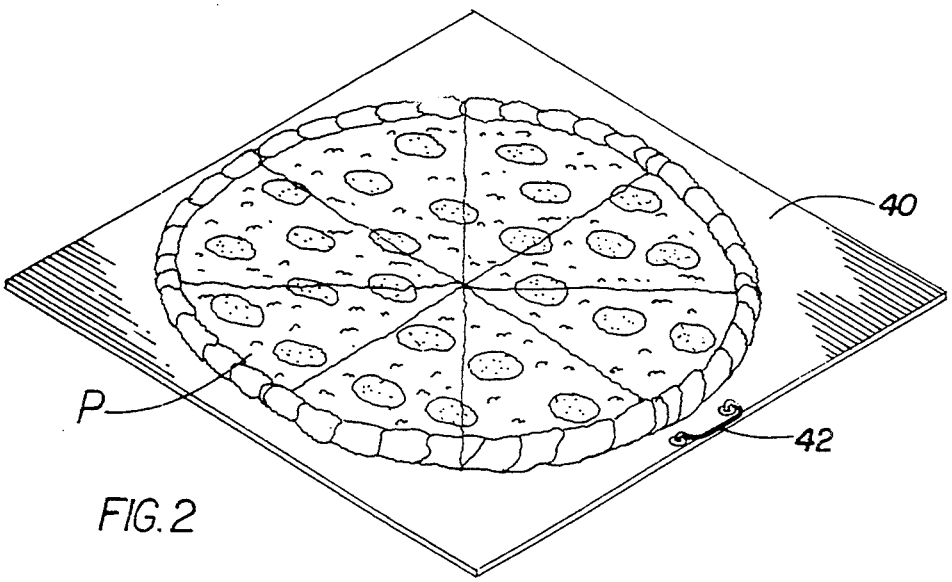
FIG. 2 is a perspective view of a slide-out member sized to be used with the box illustrated in FIG. 1, which slide-out member may be used for directly supporting the food item, to facilitate the ready insertion of the food item into the box, as well as the ready removal of the food item from the box.

In FIG. 2, I reveal the use of a slide-out member 40 upon which the food item may directly rest. A member 40 may be optionally utilized in the box 10, and as is obvious, the member 40 is of a width to be accommodated between the side members 44 and 48 without binding, such that the member 40 may be slid in or out of the box relatively easily. The front to back dimension of the member 40 is such that when the rear portion of the member 40 is touching the rearmost portion of the box, the front flap 46 can still be easily closed.

The member 40 is preferably constructed of the same material as the box 10, and to make it relatively easy to remove the food item from the box, I prefer to utilize a pull out tab 42 on the front of the member 40.

Significant to this invention is the previously-mentioned heat-retaining member 20, which is held by a member-retention means located on the interior of the box 10, on the underside of the top or lid 12. The member 20 is comparatively flat, and it serves to keep food carried in the box quite warm for a protracted length of time. As best seen in FIG. 3, the member 20 is held by appropriate securing means 52 to the underside of the top member or lid 12 of the box 10. The securing means may take the form of straps, strips or the like, which may be made of nylon, for example. The ends of such straps or thongs may be glued to the interior of the top member in spaced, preascertained locations or, alternatively, the ends of the straps or strips may be pushed through holes placed in appropriate locations on the top member of the box, and then the ends knotted to prevent them from pulling back through the holes.

As alternatives, the heat retaining member 20 may be held by an adhesive or by stapling to the interior portion of the top member 12. In some instances it may be desirable to construct my novel warm food boxes to be reusable. The utilization of the slide-out member 40 is particularly desirable when possible reuse of a box is being considered.

The heat-retaining member 20 is typically a type of plastic envelope into which a particular type of heat retaining substance, called a heat storing mass, is sealed. As will be noted in FIG. 3, I prefer to subdivide the member 20 into a number of pocket-like members 54, preferably of a consistent size. This arrangement is used in order to prevent the material used as the heat storing mass tending to become unevenly distributed, and to bunch up at only one portion of the member 20.

Any of a number of heat retaining substances are referred to in the patents of the prior art, and in the Johnson U.S. Pat. No. 5,052,369 for example, it was mentioned that a heat storing mass may consistent of any FDA approved material, such as common paraffin, or paraffin combined with different percentages of other materials, such as stearic acid, carnauba wax, or sodium chloride to obtain higher fusion temperatures. Also mentioned was a polyethylene wax having an approximate composition of 60% paraffin, 20% ethyl vinyl acetate, 19% talc and 1% colorants, and having a fusion temperature of 212° F.

This is illustrative of the fact that I may utilize any of a wide range of materials as the heat storing mass, but obviously I am not to be limited to any of these particular materials. Despite all of these options, my preference is to use water in the pocket-like members 54, because water is inexpensive, non-toxic, and satisfactorily used in most instances. Quite advantageously, if one or more of the pocket-like members broke or became somewhat leaky, the food item would not become contaminated or inedible in the event that water had been used as the heat retaining substance.

The height of the sides 24, 26 and 28 and the height of the flaps 44, 46 and 48 are such as to provide an appropriate amount of space between the underside of the member 20 and the bottom of the box 10. On the one hand, there should be sufficient space to permit the insertion of a flat food item into the space between the member 20 and the bottom member 32, but on the other hand, it is desirable for the food item to be close enough to the preheated member 20 as to be maintained at a desirably high temperature.

Although I mentioned hereinabove that the container 20 for the heat retaining material is to be disposed close to the food item residing in the box when the lid has been closed, it is to be understood that the container may in many instances be in direct physical contact with the top surface of the food item. In other words, I construe the words "disposed close to the food item" to include the heated container 20 being in touching contact with the pizza or other flat food item.

I have found that the container 20, quite advantageously, inhibits the escape of heat from the food item with which it is in close contact, as well as furnishing a highly effective source of heat. As a result of this combinational effect, I have found that a pizza can be kept quite warm for one-half to three-quarters of an hour.

By placing the box into a heat source, such as a microwave oven, for a relatively short period of time just before the box is to receive the food item, the heat retaining member 20 can be brought up to a desirably high temperature immediately before use. At such time the food item has been cooked, it is to be promptly inserted into the box, with the expectation that the food item will be caused by the heated container 20 to remain substantially at such temperature for a protracted length of time.

As an option, the heat retaining member 20 could be heated separately and then inserted into the member-retaining means located in the upper interior portion of the lid 12 of the box 10.

Although the container 20 can be heated to a relatively high temperature from the standpoint of food about to be ingested, the material sealed inside the container is never to be heated to a temperature closely approaching its boiling point.

As to the size of my novel warm food box, it can range from small to large, depending on the size food item to be placed therein. In the case of a pizza, the diameter of the pizza is obviously a very important consideration, but in addition, the flaps are to be sized so as to be of a height that is appropriate for the thickness of the food item to be placed in the box. Some pizzas have a comparatively thick crust, whereas others have a comparatively thin crust.

Furthermore, the flaps should be sized so as to take into consideration whether or not a slide out member is utilized. The preferable arrangement is for the near side of the heated container 20 to be quite close to the food item, with touching contact being quite appropriate in many instances.

I claim:

1. A flat, comparatively shallow box containing means for keeping a comparatively flat food item warm in its interior for a protracted length of time, said box having rectangularly-shaped top and bottom members of approximately equal size, which top and bottom members are hingedly secured together by hinge means disposed along an edge common to both members, said top member having an underside and also having side members disposed along each of its other three side edges, said bottom member likewise having three other edges and having a flap disposed on the side edge opposite said hinge means, such that closure of said box can be effected after a comparatively flat food item has been inserted into the interior of said box, said means for keeping a food item warm being a container for a heat-retaining substance, said container being disposed in the interior of said box, affixed to said underside of said top member, said container thus being disposed close to the food item when said box has been closed, the heat-retaining substance, having been brought up to a selected raised temperature, serving by the substance being relatively close to the food item when said top member has been closed, to keep the food item warm.

2. The flat, comparatively shallow box containing means for keeping a comparatively flat food item warm for a protracted length of time as recited in claim 1 in which said container is secured to said top member, such that said container will be warmed when the entire box is placed in contact with a heat source.

3. The flat, comparatively shallow box containing means for keeping a comparatively flat food item warm for a protracted length of time as recited in claim 1 in which said top member contains securing means, enabling said container to be removably retained on the underside of said top member after said container has been warmed by contact with a heat source.

4. The flat, comparatively shallow box containing means for keeping a comparatively flat food item warm for a protracted length of time as recited in claim 1 in which said container is subdivided into a number of separate compartments, so that the heat-retaining substance will be maintained in a substantially evenly spaced relationship across said container.

5. The flat, comparatively shallow box containing means for keeping a comparatively flat food item warm for a protracted length of time as recited in claim 1 in which restraint means are disposed adjacent said hinge means disposed along the edge common to both members, said restraint means preventing said box from being widely opened when to do so would be to possibly cause personal injury from said heated container affixed to said top member.

6. The flat, comparatively shallow box containing means for keeping a comparatively flat food item warm for a protracted length of time as recited in claim 5 in which an insert member, approximately the size of said bottom member, is utilized for directly supporting the food item.

7. A flat box containing means in its interior for keeping a food item warm for a protracted length of time, said box having rectangularly shaped top and bottom members of approximately equal size, which top and bottom members each have four edges, and which members are hingedly secured together by the use of hinge means disposed along one common edge, said top member having an underside as well as side members disposed along each of its other three edges, and a flap disposed along at least some of said edges of said bottom member, said flaps being of substantially consistent height, such that when said top and bottom members have been moved into a closed relationship with said flaps tucked inside said side members of said top member, said top and bottom members will be disposed a preascertained distance apart, said means for keeping a food item warm being a substantially flat container into which a heat-retaining substance is sealed, said container being located in the interior of said box, on said underside of said top member, so as to be disposed close to the food item located in the interior of said box when said box has been closed, the heat retaining substance, when brought up to a selected raised temperature, serving to keep the food item warm.

8. The flat, comparatively shallow box containing means for keeping a comparatively flat food item warm for a protracted length of time as recited in claim 7 in which said container is secured to said top member, such that said container will be warmed when the entire box is placed in contact with a heat source.

9. The flat, comparatively shallow box containing means for keeping a comparatively flat food item warm for a protracted length of time as recited in claim 7 in which said top member contains securing means, enabling said container to be inserted into said top member and removably retained therein after being warmed by contact with a heat source.

10. The flat, comparatively shallow box containing means for keeping a comparatively flat food item warm for a protracted length of time as recited in claim 7 in which said container is subdivided into a number of separate compartments, so that the heat-retaining substance will be maintained in a substantially evenly spaced relationship across said container.

11. The flat, comparatively shallow box containing means for keeping a comparatively flat food item warm for a protracted length of time as recited in claim 7 in which restraint means are disposed adjacent said hinge means disposed along the edge common to both members, to prevent said box being widely opened and thus possibly bring about personal injury from a heated container.

12. The flat, comparatively shallow box containing means for keeping a comparatively flat food item warm for a protracted length of time as recited in claim 11 in which an insert member, approximately the size of said bottom member, is utilized for directly supporting the food item.

13. A flat, comparatively shallow box containing means for keeping a comparatively flat food item warm in its interior for a protracted length of time, said box having rectangularly-shaped top and bottom members of approximately equal size, which top and bottom members each have four edges, said top and bottom members being hingedly secured together by the use of hinge means disposed along an edge common to both members, said top member having an underside as well as having side members disposed along each of its other three edges, said substantially flat bottom member having a plurality of flaps, with one flap disposed on the edge opposite said hinge means, said sides of said top member and said flaps of said bottom member being of similar height dimensions, so that said top and bottom members will be disposed a substantially consistent distance apart when said box has been closed with said flaps placed inside said side members of said top member, said means for keeping the food item warm in the interior of said box being a substantially flat container in which a heat-retaining substance is sealed, said container being disposed on the interior of said box, on said underside of said top member, said container thus being located close to the food item when said box has been closed with the food item inside, said heat retaining substance, having been brought up to a selected raised temperature, serving by its closeness to the food item to keep the food item warm.

14. The flat, comparatively shallow box containing means for keeping a comparatively flat food item warm for a protracted length of time as recited in claim 13 in which said container is secured to said top member, such that said container will be warmed when the entire box is placed in contact with a heat source.

15. The flat, comparatively shallow box containing means for keeping a comparatively flat food item warm for a protracted length of time as recited in claim 13 in which said top member contains securing means, enabling said container to be removably retained on the underside of said top member after said container has been warmed by contact with a heat source.

16. The flat, comparatively shallow box containing means for keeping a comparatively flat food item warm for a protracted length of time as recited in claim 13 in which said container is subdivided into a number of separate compartments, so that the heat-retaining substance will be maintained in a substantially evenly spaced relationship across said container.

17. The flat, comparatively shallow box containing means for keeping a comparatively flat food item warm for a protracted length of time as recited in claim 13 in which restraint means are disposed adjacent said hinge means disposed along the edge common to both members, said restraint means preventing said box from being widely opened when to do so would be to possibly cause personal injury from a heated container affixed to said top member.

18. The flat, comparatively shallow box containing means for keeping a comparatively flat food item warm for a protracted length of time as recited in claim 17 in which an insert member, approximately the size of said bottom member, is utilized for directly supporting the food item.

* * * * *